United States Patent [19]

Yonezawa

[11] 4,143,484

[45] Mar. 13, 1979

[54] DRIVE MECHANISM FOR A RUNNING TOY

[75] Inventor: Hiroichi Yonezawa, Matsudo, Japan

[73] Assignee: Kabushiki Kaisha Yoneya Gangu, Tokyo, Japan

[21] Appl. No.: 743,477

[22] Filed: Nov. 19, 1976

[30] Foreign Application Priority Data

Jul. 22, 1976 [JP] Japan ..... 51-96774

[51] Int. Cl.[2] ..... A63H 11/10

[52] U.S. Cl. ..... 46/104; 46/124

[58] Field of Search ..... 46/102, 104, 124, 98, 46/99

[56] References Cited

U.S. PATENT DOCUMENTS

| | | | |
|---|---|---|---|
| 2,035,308 | 3/1936 | Ferber | 46/104 |
| 2,194,537 | 3/1940 | Adams | 46/104 |
| 2,232,615 | 2/1941 | Kupa | 46/104 |
| 2,728,168 | 12/1955 | Gier | 46/103 |
| 3,181,270 | 5/1965 | Trevena | 46/104 |
| 3,490,172 | 1/1970 | Schwartz | 46/124 |
| 3,538,639 | 11/1970 | Tomaro | 46/98 |

*Primary Examiner*—Russell R. Kinsey
*Assistant Examiner*—Robert F. Cutting
*Attorney, Agent, or Firm*—Burns, Doane, Swecker & Mathis

[57] ABSTRACT

A moving toy includes a plurality of articulated, body-forming members configured as a crawling animal. A wheeled, forward member includes drive means for propelling the toy and an actuating means with radially extending arms. The actuating means contacts a lever on an adjacent body forming member to intermittently pivot the members, thereby simulating an arching or undulating motion in a rearward portion of the toy.

6 Claims, 3 Drawing Figures

DRIVE MECHANISM FOR A RUNNING TOY

BACKGROUND OF THE INVENTION

The present invention relates to a toy apparatus which simulates a crawling animal both in appearance and movement.

The so-called "measuring worm", "inch worm", "span worm" or "looper" may be used as a model to provide an attractive toy. However, the distinctive movement of such animals, i.e. the arching or spanning of the body resembling the fingers measuring a distance, is important to the appeal and recognizability of any toy replica of the animals.

Accordingly, it is a primary object of the present invention to provide a toy apparatus which simulates the "measuring worm", "inch worm", "span worm" or "looper" in both appearance and movement.

More specifically, it is an object of the present invention to provide a toy worm which is driven so that the forward motion of the head portion of the worm intermittently slows while a rear portion of the toy arches upwardly.

It is another object of the present invention to provide a self-propelled running animal toy with an inexpensively and easily fabricated mechanism for simulating the spanning motion of a worm or the horizontal undulations of a snake.

These and other objects and features of the present invention will be more fully apparent from the claims and from the following description when read in conjunction with the drawings.

THE DRAWINGS

DETAILED DESCRIPTION

Figure 1:
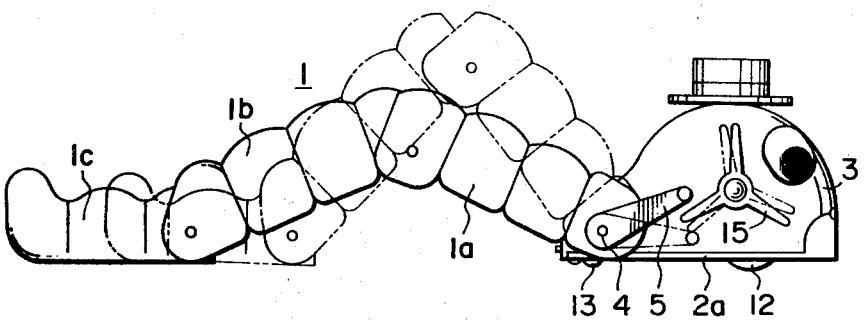
FIG. 1 is a side view of a toy measuring worm incorporating the drive mechanism of an embodiment of the present invention.
Figure 2:
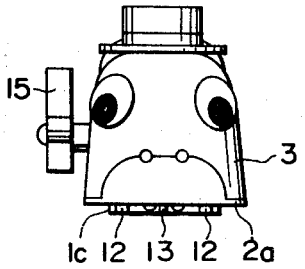
FIG. 2 is a front view of the above-mentioned toy measuring worm of FIG. 1; and, FIG. 3 is a side view of the drive mechanism of an embodiment of the present invention.

This invention relates to a drive mechanism for a moving toy particularly adapted for use in the configuration of a toy "inch", "span", or "measuring" worm.

A drive mechanism of a moving toy of a simplified construction is provided which may be adapted very suitably for a toy measuring worm and which can be produced easily and economically. The toy mechanism may comprise of a plurality of articulated body-forming members, connected pivotally with each other. A forward body-forming member may be configured as a head of the animal and include a machine frame or chassis, a second body forming member may be pivotably attached to the chassis. A lever may be formed integrally with the second body-forming member and may be engaged to a pivot connecting the second body forming member to the machine frame or to the head member. Drive means may be carried by the machine frame. Wheels rotatably mounted to said machine frame may be driven by the drive means. An axle, operatively connected to the drive means, may be equipped with a toothed whee to engage and actuate above-said lever intermittently during rotation thereof.

An embodiment of the present invention will now be described with reference to the accompanying drawings showing a toy measuring worm and associated drive mechanism.

The reference numeral 1 designates a body which may consist of four articulated, body-forming member 1*a*, 1*b* and 1*c* and head member 3, connected pivotally with each other. A machine-frame or chassis 2 may include a base 2*a* and a casing 2*b*. The head member 3 may be attached to the frame 2, and the second body-forming member 1*a* of the body 1 may be pivotably attached to the head member 3 by means of a shaft 4. An L-shaped lever 5 may be attached to the body-forming member 1*a* and mounted on the shaft 4 for pivoting with respect to the head.

Figure 3:
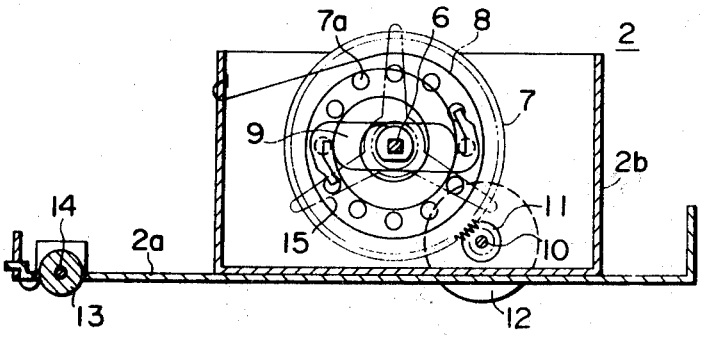

With reference to FIG. 3, a spring loaded shaft 6 may be rotatably mounted onto the casing 2*b* and gear 7 may also be rotatably mounted onto the shaft 6. The outer end of a spring 8 may be attached to the casing 2*b* while the inner end thereof may be secured to the shaft 6. A ratchet 9 may be attached to the shaft 6, and pawls at both ends thereof may intermittently engage holes 7*a* disposed circularly on the gear 7.

An axle 10 may be rotatably mounted to casing 2*b* and a pinion 11 may be secured to axle 10 so as to engage with the gear 7. Two ground engaging wheels 12 may be mounted on the axle 10, and the lower part of each wheel may protrude downwardly from the base board 2*a*. Another ground engaging wheel 13 may be rotatably mounted to a shaft 14 so that the lower section thereof protrudes downwardly from the rear part of the base board 2*a*. An actuation member 15 having three radially extending arms may be secured to one end of the shaft 6 projecting through one side of the head member 3. The member 15 may be employed as a handle for winding the spring 8.

The body-forming members 1*a*, 1*b* and 1*c* are configured so as to describe a curve defined by the three segments as shown in FIG. 1. When the actuation member 15 turns counterclockwise, an arm contacts the lever 5. As the actuation member continues counterclockwise motion, the lever 5 and attached body member 1*a*, turn clockwise exerting a force on the body-forming members 1*b* and 1*c* and reorienting the body-forming members as indicated by the broken line of FIG. 1.

The above-described embodiment uses the spring 8 as a drive mechanism and the spring shaft 6 as an axle to be actuated by the drive mechanism of this type. However, a motor may be used as the drive mechanism and another shaft may be disposed separately to perform the function of the spring shaft 6.

The toy measuring worm having the above-mentioned construction is operated in the following manner. The actuation member 15 may be rotated to wind up the spring 8. If wheels 12, 13 and the bottom section of the body-forming member 1*c* are placed on a flat surface, the toy will move under its own power. The rewinding force of the spring 8 may cause the gear 7 as well as the actuation member 15 to rotate counter-clockwise. This rotation of the gear 7 is transmitted to the pinion 11 to thereby rotate the wheel 12 clockwise, and drive the toy forward. However, when one arm of the actuation member 15 reaches and pushes the lever 5 while the actuation member 15 is rotating counter-clockwise, the lever 5 as well as the body-forming member 1*a* may be caused to rotate clockwise and pull the body-forming members 1*b* and 1*c* towards the head member 3. At this time, the body may describe the curve indicated by the broken line of FIG. 1 in much the same way as a measuring worm retracts its body and takes the posture immediately before it starts spanning.

In this instance, the actuation member 15 pushes the arm of the lever 5, thereby applying a load to the unwinding force of the spring 8. In consequence, the rotation of the shaft 6 may be retarded whereby the speed of forward advance of the head of the toy may be reduced.

As the actuation lever 15 rotates further, the arm thereof which had been pushing the lever 5 disengages the lever whereupon the toy resumes its normal speed of forward advance. Consequently, the wheel 12 rotates at the normal speed and the head member 3 moves forward together with the machine frame 1.

However, since the body 2 has been bent and the rearward body-forming member 1*c* has been in touch with a flat surface, only the head member 3 moves forward before the body-forming members 1*a* and 1*b* resume the normal posture. When the above-mentioned movement is over, a subsequent arm of the actuation member 15 may push the lever 5 and cause the lever to rotate, thereby repeating the above-described sequence of operation. Thus, the toy moves forward in the same way as the spanning movement of the measuring worm until the spring 8 is fully unwound.

The drive mechanism of the present invention is not limited to use for toys simulating a measuring worm but can be adapted for use with other toys such as a toy green caterpillar. When the drive mechanism is placed horizontally, it can also be adapted for use as toy snake, for example.

The principles, preferred embodiments and modes of operation of the present invention have been described in the foregoing specification. The invention which is intended to be protected is not, however, to be construed as limited to the particular forms disclosed, since these are to be regarded as illustrative rather than restrictive. Variations and changes may be made by those skilled in the art without departing from the spirit and scope of the present invention.

WHAT IS CLAIMED IS:

1. A moving toy apparatus comprising:

plurality of articulated body-forming members configured as a crawling animal, pivotably connected to each other including:

a first body forming member with at least one ground engaging wheel; and, a second body forming member pivotably connected to said first body forming member;

drive means for driving said wheel thereby propelling said first body forming member;

a lever, connected to said second body forming member for pivoting said second member with respect to said first body forming member; and, lever actuating means rotated by said drive means and having at least one radially extending arm for contacting said lever to intermittently pivot said second body forming member with respect to said first body forming member.

2. The apparatus of claim 1 wherein said plurality of articulated body-forming members further includes:

a third body forming member pivotably connected to said second body forming member; and, a fourth body forming member pivotably connected to said third body forming member;

whereby ends of said second and third body forming members, pivotably connected to each other, are moved upwardly by pivoting of said second member with respect to said first body forming member.

3. The apparatus of claim 1 wherein forward motion of said first body forming means intermittently slowed by loading of the drive means responsive to the intermittent pivoting of said second body forming member with respect to said first member.

4. The apparatus of claim 1 wherein energy for propelling said first body forming member is stored in said drive means by manually rotating said lever actuating means.

5. The apparatus of claim 4 wherein said drive means is a spring drive means including a spiral spring and a rotatable shaft connected to one end of said spring; and, wherein said lever actuating means is mounted on said shaft.

6. The apparatus of claim 1 wherein said lever is "L"-shaped, a first leg of which lever is attached to said second body forming member at an axis of pivoting of the member with respect to the first body forming member; and, the second leg of which "L"-shaped lever extends outwardly from a longitudinal axis of said plurality of body forming members, the second leg being intermittently contacted by the radially extending arm of said lever actuating means.

* * * * *